US010895888B2

(12) United States Patent
Makiuchi

(10) Patent No.: US 10,895,888 B2
(45) Date of Patent: Jan. 19, 2021

(54) WATCH AND MANUFACTURING METHOD OF CONSTANT CURRENT CIRCUIT

(71) Applicant: Seiko Epson Corporation, Tokyo (JP)

(72) Inventor: Yoshiki Makiuchi, Minowa (JP)

(73) Assignee: Seiko Epson Corporation

( * ) Notice: Subject to any disclaimer, the term of this patent is extended or adjusted under 35 U.S.C. 154(b) by 0 days.

(21) Appl. No.: 16/839,127

(22) Filed: Apr. 3, 2020

(65) Prior Publication Data

US 2020/0319663 A1 Oct. 8, 2020

(30) Foreign Application Priority Data

Apr. 4, 2019 (JP) ..... 2019-071807

(51) Int. Cl.
*G05F 3/26* (2006.01)
*G04C 10/00* (2006.01)
*G04C 3/14* (2006.01)

(52) U.S. Cl.
CPC ..... *G05F 3/262* (2013.01); *G04C 3/14* (2013.01); *G04C 10/00* (2013.01)

(58) Field of Classification Search
CPC ..... G05F 3/262; G04C 3/14; G04C 10/00
See application file for complete search history.

(56) References Cited

U.S. PATENT DOCUMENTS 6,140,862 A * 10/2000 Hagura ..... G05F 1/465 327/537
6,462,527 B1 * 10/2002 Maneatis ..... G05F 3/262 323/313
7,990,203 B2 * 8/2011 Kim ..... G11C 5/143 327/530
10,175,711 B1 * 1/2019 Petruzzi ..... G05F 3/262
2002/0075062 A1 6/2002 Kitade
2006/0061413 A1 * 3/2006 Kim ..... G05F 3/262 327/543
2011/0156822 A1 6/2011 Takano et al.
2012/0249114 A1 * 10/2012 Sako ..... G05F 3/262 323/312

FOREIGN PATENT DOCUMENTS

JP H11-219225 A 8/1999
JP H11-346127 A 12/1999
JP 2002-184178 A 6/2002
JP 2004-192518 A 7/2004
JP 2011-150675 A 8/2011

* cited by examiner

*Primary Examiner* — Jue Zhang
(74) *Attorney, Agent, or Firm* — Hamess, Dickey & Pierce, P.L.C.

(57) ABSTRACT

A watch is provided that includes a constant current circuit including: a plurality of transistors coupled in series between a first power supply and a second power supply, the first power supply being a power supply of a high potential side power supply, the second power supply being a power supply of a low potential side power supply; a plurality of connection wiring lines each provided for each of the plurality of transistors, and configured to couple the first power supply and a terminal on the first power supply side of each of the plurality of transistors; a non-disconnected fuse provided in a non-disconnected state to one connection wiring line of the plurality of connection wiring lines, and a disconnected fuse provided in a disconnected state to a connection wiring line other than the one connection wiring line of the plurality of connection wiring lines.

11 Claims, 7 Drawing Sheets

WATCH AND MANUFACTURING METHOD OF CONSTANT CURRENT CIRCUIT

The present application is based on, and claims priority from JP Application Serial Number 2019-071807, filed Apr. 4, 2019, the disclosure of which is hereby incorporated by reference herein in its entirety.

BACKGROUND

1. Technical Field

The present disclosure relates to a watch including a constant current circuit and a manufacturing method of a constant current circuit.

2. Related Art

As described in JP-A-11-346127, a constant current circuit is known that includes a switch circuit that selects a plurality of taps of a resistor ladder coupled in series, and a trimming circuit that controls the operation of the switch circuit.

The switch circuit is typically composed of a transistor. The switch circuit selects and turns on one switch by a decoder of the trimming circuit while turning off the other switches so as to change the resistance value of the resistor ladder, and regulates the constant current that is generated in the constant current circuit.

In the transistor of the switch circuit, the off-leakage current increases as the temperature increases, and the off-leakage current may become about 100 pA depending on the manufacture variation. As such, in the known constant current circuit, the constant current varies due to the off-leakage current of the transistor for the switch circuit. In particular, a constant current circuit for a watch that supplies a small constant current of several nanoamperes may cause a problem of a significant influence of the off-leakage current.

SUMMARY

A watch of the present disclosure includes a constant current circuit, the constant current circuit including a plurality of transistors coupled in series between a first power supply and a second power supply, the first power supply being a power supply of one of a high potential side power supply and a low potential side power supply, the second power supply being a power supply of the other of the high potential side power supply and the low potential side power supply, a plurality of connection wiring lines each provided for each of the plurality of transistors, each of the plurality of connection wiring lines being configured to couple the first power supply and a terminal on the first power supply side of each of the plurality of transistors, a non-disconnected fuse provided in a non-disconnected state to one connection wiring line of the plurality of connection wiring lines, and a disconnected fuse provided in a disconnected state to a connection wiring line other than the one connection wiring line of the plurality of connection wiring lines.

A watch of the present disclosure includes a constant current circuit, the constant current circuit including a plurality of resistors coupled in series between a first power supply and a second power supply, the first power supply being a power supply of one of a high potential side power supply and a low potential side power supply, the second power supply being a power supply of the other of the high potential side power supply and the low potential side power supply, a plurality of connection wiring lines each provided for each of the plurality of resistors, each of the plurality of connection wiring lines being configured to couple the first power supply and a terminal on the first power supply side of each of the plurality of resistors, a non-disconnected fuse provided in a non-disconnected state to one connection wiring line of the plurality of connection wiring lines, and a disconnected fuse provided in a disconnected state to a connection wiring line other than the one connection wiring line of the plurality of connection wiring lines.

In the watch of the present disclosure, the constant current circuit may include a plurality of simulation disconnecting transistors configured to switch each of the plurality of connection wiring lines between a disconnected state and a connected state.

In the watch of the present disclosure, the constant current circuit may include a plurality of disconnection determination wiring lines configured to implement coupling between the second power supply, and the non-disconnected fuse and the disconnected fuse, and a plurality of disconnection determining transistors may be coupled to each of the plurality of disconnection determination wiring lines.

The watch of the present disclosure may further include a constant voltage circuit configured to receive a constant current output from the constant current circuit and output a constant voltage, and an oscillation circuit driven by the constant voltage output from the constant voltage circuit.

DESCRIPTION OF EXEMPLARY EMBODIMENTS

First Embodiment

A watch 1 of a first embodiment of the present disclosure will be described below with reference to the drawings.

Figure 1:
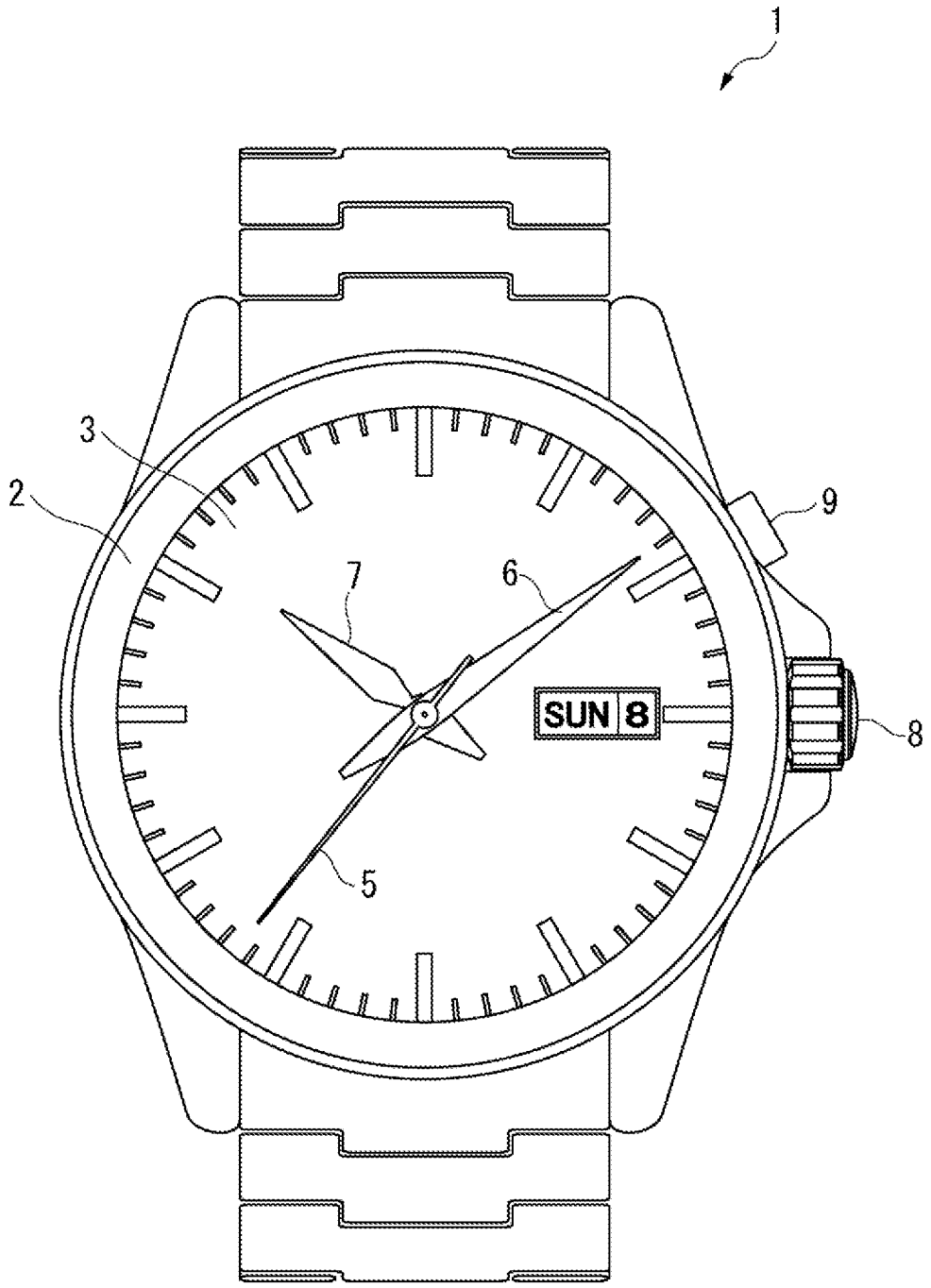
FIG. 1 is a front view illustrating a watch of a first embodiment.
Figure 2:
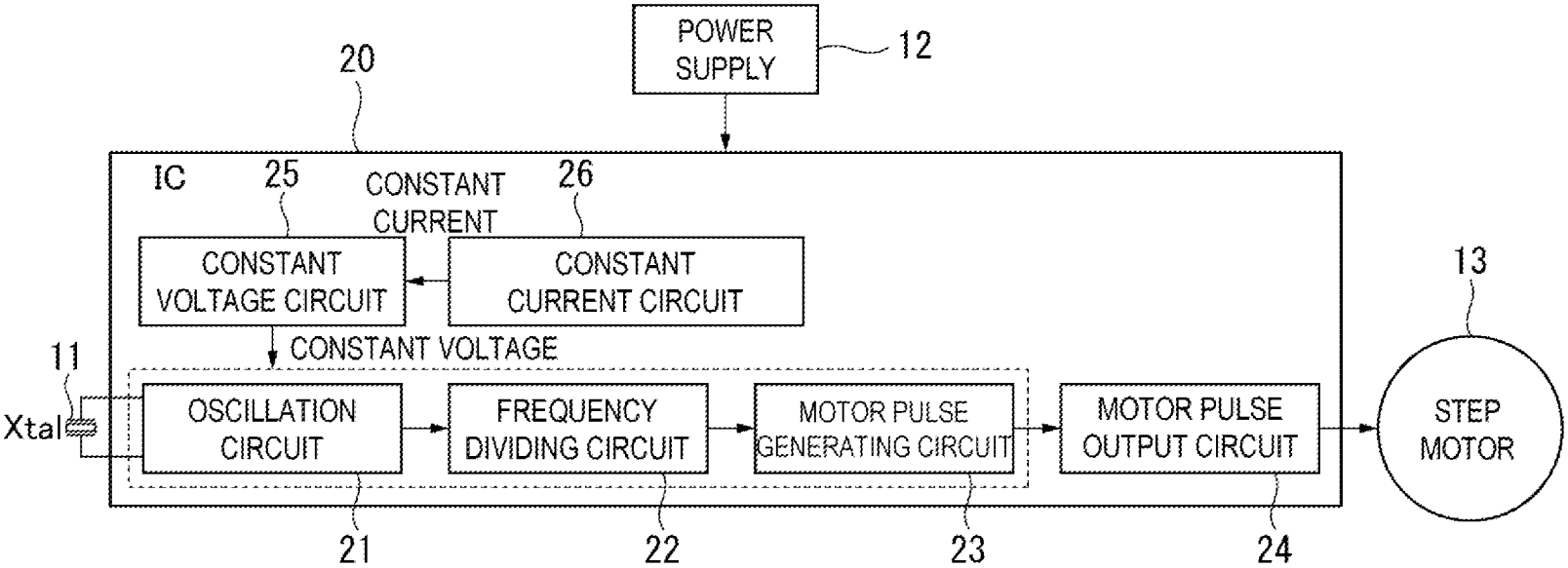
FIG. 2 is a block diagram illustrating a movement of the watch of the first embodiment.

In FIG. 1, the watch 1 is an electronic watch configured to be worn around the wrist of the user, and includes an outer case 2, an dial 3 having a disc shape, a movement (not illustrated), and a second hand 5, a minute hand 6 and an hour hand 7, which are hands configured to be driven by a step motor 13 provided in the movement as also illustrated in FIG. 2, and, a crown 8 and a button 9, which are operation members.

In FIG. 2, the watch 1 includes a crystal oscillator 11 serving as a reference signal source, a power supply 12 such as a battery, the step motor 13 configured to drive the second hand 5, the minute hand 6 and the hour hand 7 serving as hands, and a watch IC 20 configured to control the step motor 13.

The second hand 5, the minute hand 6, and the hour hand 7 are interlocked by a train wheel (not illustrated) and are driven by the step motor 13 so as to display seconds, minutes, and hours. While the second hand 5, the minute hand 6, and the hour hand 7 are driven by one step motor 13 in the present embodiment, a plurality of motors, such as a motor that drives the second hand 5 and a motor that drives the minute hand 6 and the hour hand 7, may be provided.

The IC 20 includes an oscillation circuit 21, a frequency dividing circuit 22, a motor pulse generating circuit 23, and a motor pulse output circuit 24.

The oscillation circuit 21 causes high-frequency oscillation of the crystal oscillator 11 serving as a reference signal source, and outputs an oscillation signal of a predetermined frequency generated by the high frequency oscillation to the frequency dividing circuit 22.

The frequency dividing circuit 22 divides the output of the oscillation circuit 21 and supplies a timing signal, i.e., a clock signal, to the motor pulse generating circuit 23.

The motor pulse generating circuit 23 controls the driving of the second hand 5, the minute hand 6, and the hour hand 7 by supplying a drive current to the step motor 13 through the motor pulse output circuit 24.

The IC 20 includes a constant voltage circuit 25 that outputs a constant voltage required for the oscillation circuit 21, and a constant current circuit 26 that outputs a constant current required for the constant voltage circuit 25.

Among them, the constant voltage circuit 25 has a known configuration that outputs a constant voltage when a constant current output from the constant current circuit 26 is input. The constant current circuit 26 is configured to eliminate or reduce an off-leakage current in accordance with the present disclosure.

Figure 3:
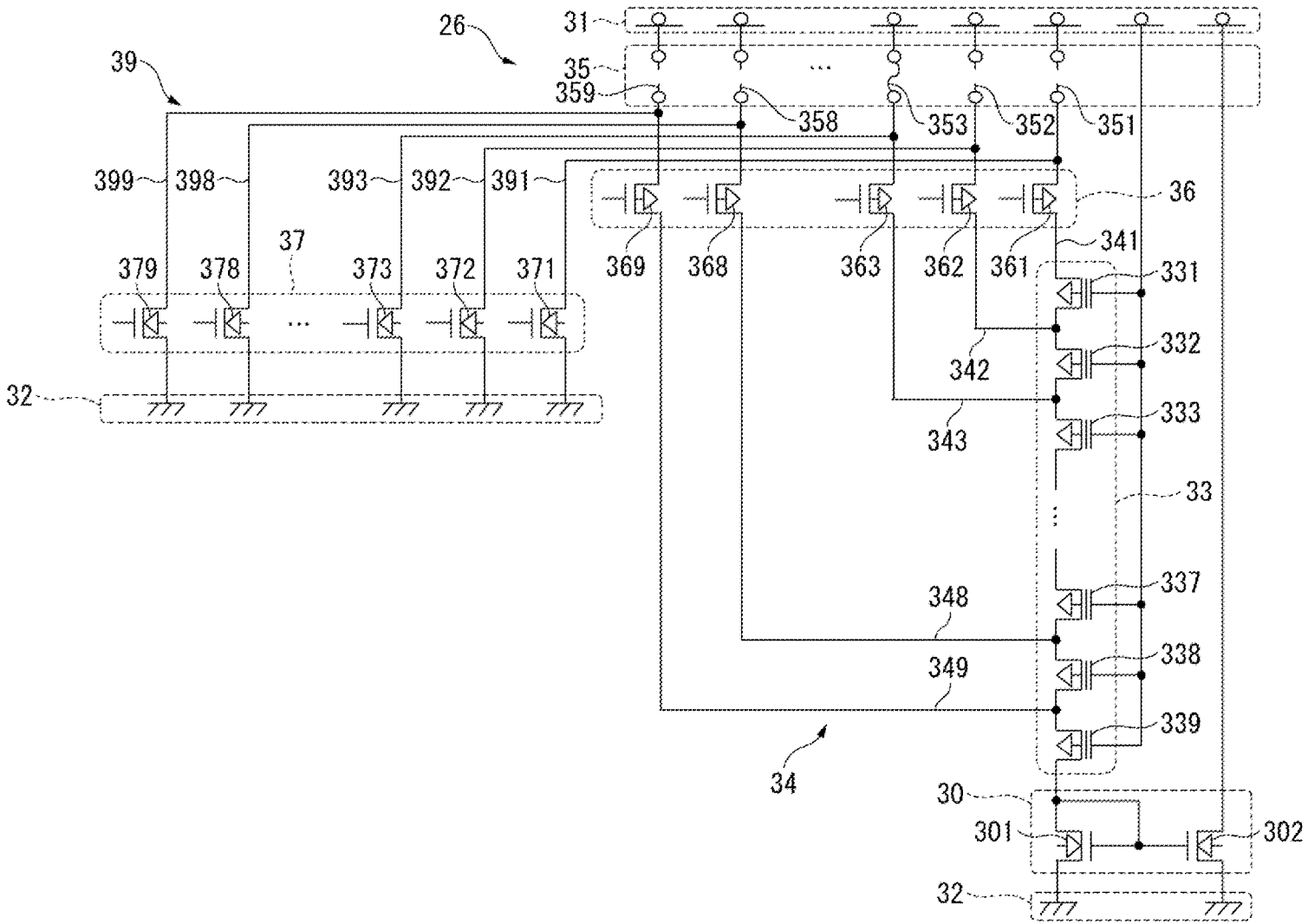
FIG. 3 is a circuit diagram illustrating a constant current circuit of the movement of the first embodiment.

In FIG. 3, the constant current circuit 26 is coupled to a first power supply 31, which is a high potential side power supply, and a second power supply 32, which is a low potential side power supply. A direct current voltage VDD is supplied to the first power supply 31 from the power supply 12, and a direct current voltage VSS is supplied to the second power supply 32 from the power supply 12.

The constant current circuit 26 includes a current mirror circuit 30, a regulating transistor group 33, a connection wiring line group 34, a selecting fuse group 35, a simulation disconnecting transistor group 36, a disconnection determining transistor group 37, and a disconnection determination wiring line group 39.

The current mirror circuit 30 includes two current stabilizing transistors, 301 and 302, coupled between the first power supply 31 and the second power supply 32.

The regulating transistor group 33 includes a plurality of regulating transistors 331 to 339 coupled in series between the first power supply 31 and the current stabilizing transistor 301.

The regulating transistors 331 to 339 are depletion PMOS transistors. Note that in FIG. 3, only the regulating transistors 331 to 333 and 337 to 339 are illustrated, and the others are omitted.

The connection wiring line group 34 includes a plurality of connection wiring lines 341 to 349 disposed between the regulating transistor group 33 and the first power supply 31 for the regulating transistors 331 to 339, respectively. The connection wiring lines 341 to 349 couple the first power supply 31 and respective terminals on the first power supply 31 side. Note that in FIG. 3, only the connection wiring lines 341 to 343, 348 and 349 are illustrated, and the others are omitted.

The selecting fuse group 35 and the simulation disconnecting transistor group 36 are disposed in the connection wiring line group 34. In addition, the disconnection determination wiring line group 39 is coupled to the connection wiring line group 34, and the disconnection determining transistor group 37 is disposed at the disconnection determination wiring line group 39.

The selecting fuse group 35 includes a plurality of selecting fuses 351 to 359. The selecting fuses 351 to 359 are inserted to the connection wiring lines 341 to 349, respectively, of the connection wiring line group 34, and are disposed between the first power supply 31 and the regulating transistors 331 to 339 in the respective connection wiring lines 341 to 349. Note that in FIG. 3, only the selecting fuses 351 to 353, 358 and 359 are illustrated, and the others are omitted.

One selecting fuse, 353, of the selecting fuses 351 to 359 is a non-disconnected fuse in a non-disconnected state, and the others are disconnected fuses in a disconnected state.

Thus, of the plurality of connection wiring lines 341 to 349, conduction of only one connection wiring line, 343, corresponding to the non-disconnected selecting fuse 353 is maintained, and conduction of the remaining connection wiring lines 341, 342 and 344 to 349 is cut off.

The simulation disconnecting transistor group 36 includes simulation disconnecting transistors 361 to 369 disposed between the regulating transistor group 33 and the selecting fuse group 35 of the connection wiring lines 341 to 349, respectively. Note that in FIG. 3, only the simulation disconnecting transistors 361 to 363, 368 and 369 are illustrated, and the others are omitted.

The simulation disconnecting transistors 361 to 369 can be switched between conduction and cutoff by applying an external signal, and can switch the corresponding connection wiring lines 341 to 349 between a connected state and a disconnected state. For example, even when the selecting fuse 351 is non-disconnected in the connection wiring line 341, a disconnected state of the connection wiring line 341 can be simulated by putting the simulation disconnecting transistor 361 into a cutoff state as with the state where the selecting fuse 351 is disconnected.

The disconnection determination wiring line group 39 includes disconnection determination wiring lines 391 to 399 that are branched off between the simulation disconnecting transistor group 36 and the selecting fuse group 35 of the connection wiring lines 341 to 349, respectively, and are coupled to the second power supply 32. Note that in FIG. 3, only the disconnection determination wiring lines 391 to 393, 398 and 399 and the disconnection determining transistors 371 to 373, 378 and 379 are illustrated, and the others are omitted.

The disconnection determining transistor group 37 includes disconnection determining transistors 371 to 379 disposed at the disconnection determination wiring lines 391 to 399, respectively. Note that in FIG. 3, only the disconnection determining transistors 371 to 373, 378 and 379 are illustrated, and the others are omitted.

Thus, in the disconnection determining transistors 371 to 379, only the connection wiring lines 341 to 349 whose corresponding selecting fuses 351 to 359 are non-disconnected are put into conduction when put into a conductive state by an external signal, and it is thus possible to determine the disconnection/non-disconnection of the selecting fuses 351 to 359.

In the constant current circuit 26 according to the present embodiment, the output current is set by the following operations.

In the manufacturing stage of the IC 20, all the plurality of selecting fuses 351 to 359 are in a non-disconnected state in the selecting fuse group 35 of the constant current circuit 26. Prior to incorporation into the watch 1, regulation is performed so as to obtain the desired output current.

In the regulation, a predetermined voltage is supplied from the first power supply 31 and the second power supply 32, and the output current is measured.

In the initial state, all the selecting fuses 351 to 359 are non-disconnected, and all the connection wiring lines 341 to 349 are put into conduction.

Here, by using the simulation disconnecting transistor group 36, only one of the connection wiring lines 341 to 349 is put into conduction, and the other connection wiring lines are put into a cutoff state. For example, in the case where only the simulation disconnecting transistor 362 is put into conduction and the other transistors are cut off, only the corresponding connection wiring line 342 is put into conduction, and a current resulting from the series connection of the regulating transistors 332 to 339 is output. By sequentially performing a simulation disconnection in which only one of the connection wiring lines 341 to 349 is put into conduction and the other connection wiring lines are put into the cutoff state, the number of regulating transistors coupled in series from the regulating transistor 339 side, in the regulating transistors 331 to 339, can be changed, and any selection by which a desired current is obtained can be simulated.

When any of the connection wiring lines 341 to 349 to be selected is determined, all the selecting fuses 351 to 359 are disconnected except for one of them left non-disconnected. The selecting fuse group 35 is manufactured with a wiring material such as aluminum and is disconnected by means of laser light irradiation or the like. For example, to select the connection wiring line 342, only the selecting fuse 352 is left as a non-disconnected fuse, and the others are disconnected as disconnected fuses.

When fuse disconnection of the selecting fuse group 35 has been performed, disconnection determination of the selecting fuses 351 to 359 is performed by the disconnection determining transistor group 37.

In the disconnection determining transistors 371 to 379, when put into conduction by an external signal, only the connection wiring lines 341 to 349 whose corresponding selecting fuses 351 to 359 are non-disconnected can be determined to be in a conductive state. Thus, whether the selecting fuses 351 to 359 to be disconnected are appropriately disconnected can be determined.

The IC 20 whose output current has been set is incorporated into the watch 1 and set in a normal operating state. When incorporated in watch 1, all the simulation disconnecting transistors 361 to 369 are put into a conductive state, and all the disconnection determining transistors 371 to 379 are put into a cutoff state.

Even when all the simulation disconnecting transistors 361 to 369 are put in a conductive state, all the selecting fuses 351 to 359 are disconnected except for one of them, and no off-leakage occurs from the connection wiring lines 341 to 349 in the disconnected state.

Since the disconnection determining transistors 371 to 379 are configured for disconnection determination of the selecting fuses 351 to 359 and are not configured for feeding a current, and thus a transistor whose off-leakage current is small can be used even when the capacity is low and the temperature is high. Thus, even when all the disconnection determining transistors 371 to 379 are put into a cutoff state, there is almost no influence of the off-leakage current on the constant current.

According to the present embodiment described above, the following effects can be achieved.

In the present embodiment, by disconnecting all the selecting fuses 351 to 359 except for one of them in the selecting fuse group 35, any of the regulating transistors 331 to 339 corresponding to the non-disconnected selecting fuses can be selected and regulation to a desired current corresponding to the selected regulating transistor can be performed.

Since the selecting fuses 351 to 359 are used for the selection of the regulating transistors 331 to 339, the off-leakage current of a known selective transistor does not occur, and therefore it is suitable for the constant current circuit 26 for a watch that supplies a weak constant current.

In particular, in the constant current circuit 26, the constant current output in the absence of leakage current has a constant slope with respect to the temperature, whereas when the leakage current is added, the slope increases with increasing temperature, rather than being constant with respect to the temperature. Consequently, the temperature characteristics of the constant current circuit cannot be managed, and when the constant current circuit is used as a constant current source of a constant-voltage generation circuit, a thermosensitive oscillation circuit or the like, the temperature characteristics of such a circuit is not constant, and the influence is large.

In the present embodiment, by eliminating the off-leakage current by using the selecting fuses 351 to 359, the temperature characteristics of the constant current that is supplied from the constant current circuit 26 to the constant voltage circuit 25 can be stabilized, and the temperature characteristics as the oscillation circuit 21 or the watch 1 can be stabilized.

In the present embodiment, the fuse disconnection for selection of the selecting fuses 351 to 359 can be appropriately performed by providing the simulation disconnecting transistors 361 to 369 and by performing a simulation operation prior to disconnection of the selecting fuses 351 to 359.

In the present embodiment, the result of the fuse disconnection can be confirmed by providing the disconnection determining transistors 371 to 379 and by detecting the conduction of the selecting fuses 351 to 359.

Second Embodiment

Figure 4:
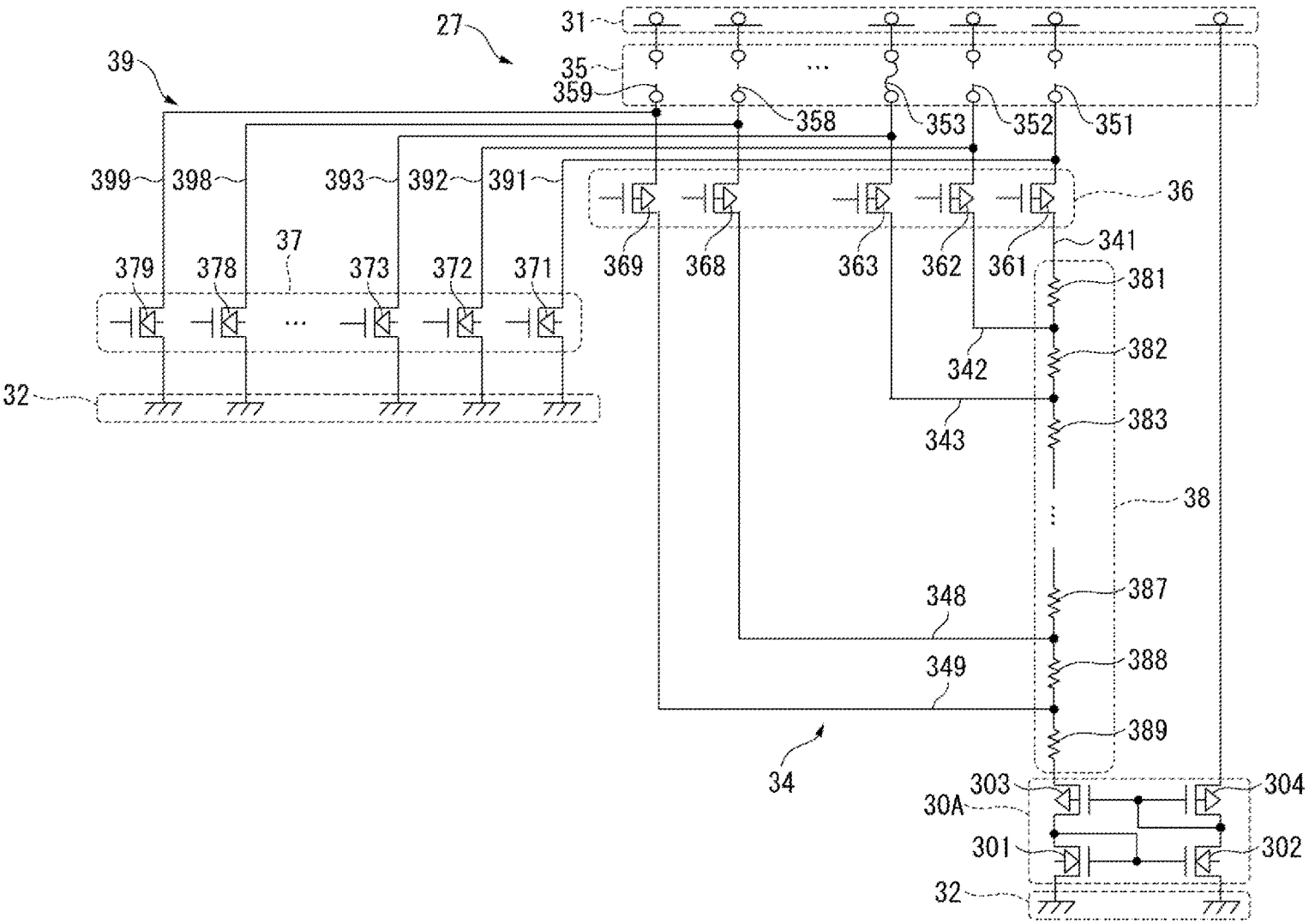
FIG. 4 is a circuit diagram illustrating a constant current circuit of a second embodiment.

FIG. 4 illustrates a second embodiment of the present disclosure.

In the present embodiment, the configurations of the watch 1 and the IC 20 are the same as those of the first embodiment, and therefore overlapping descriptions thereof will be omitted. The present embodiment differs from the first embodiment in that a constant current circuit 27 is provided in place of the constant current circuit 26 in the IC 20 of the first embodiment.

As with the constant current circuit 26 of the first embodiment, the constant current circuit 27 includes the connection wiring line group 34, the selecting fuse group 35, the simulation disconnecting transistor group 36, the disconnection determining transistor group 37, and the disconnection determination wiring line group 39. Overlapping descriptions of the same configurations are omitted.

The present embodiment differs from the first embodiment in that a regulating resistor group 38 is disposed in place of the regulating transistor group 33 of the first embodiment, and a current mirror circuit 30A is disposed in place of the current mirror circuit 30 of the first embodiment.

The current mirror circuit 30A is a circuit that includes a pair of current stabilizing transistors 303 and 304 in addition to the pair of current stabilizing transistors 301 and 302.

The regulating resistor group 38 is a ladder resistance in which the regulating resistance elements 381 to 389 are coupled in series. Note that in FIG. 4, only the regulating resistance elements 381 to 383, 387 and 389 are illustrated, and the others are omitted.

The connection wiring lines 341 to 349 of the connection wiring line group 34 couple the first power supply 31 and terminals on the first power supply 31 side of the regulating resistance elements 381 to 389, respectively. Note that in FIG. 4, only the connection wiring lines 341 to 343, 348 and 349 are illustrated, and the others are omitted.

In such an embodiment, the fixed current can be regulated by selecting the disconnected state and the non-disconnected state of the selecting fuses 351 to 359 to regulate the number of series connections of the regulating resistance elements 381 to 389. In addition, since the selecting fuses 351 to 359 are used for the selection of the connection wiring lines 341 to 349, the off-leakage current of a known selective transistor does not occur, and therefore it is suitable for the constant current circuit 27 for a watch that supplies a weak constant current.

Thus, the present embodiment can also achieve effects similar to the effects of the above-described first embodiment.

Third Embodiment

Figure 5:
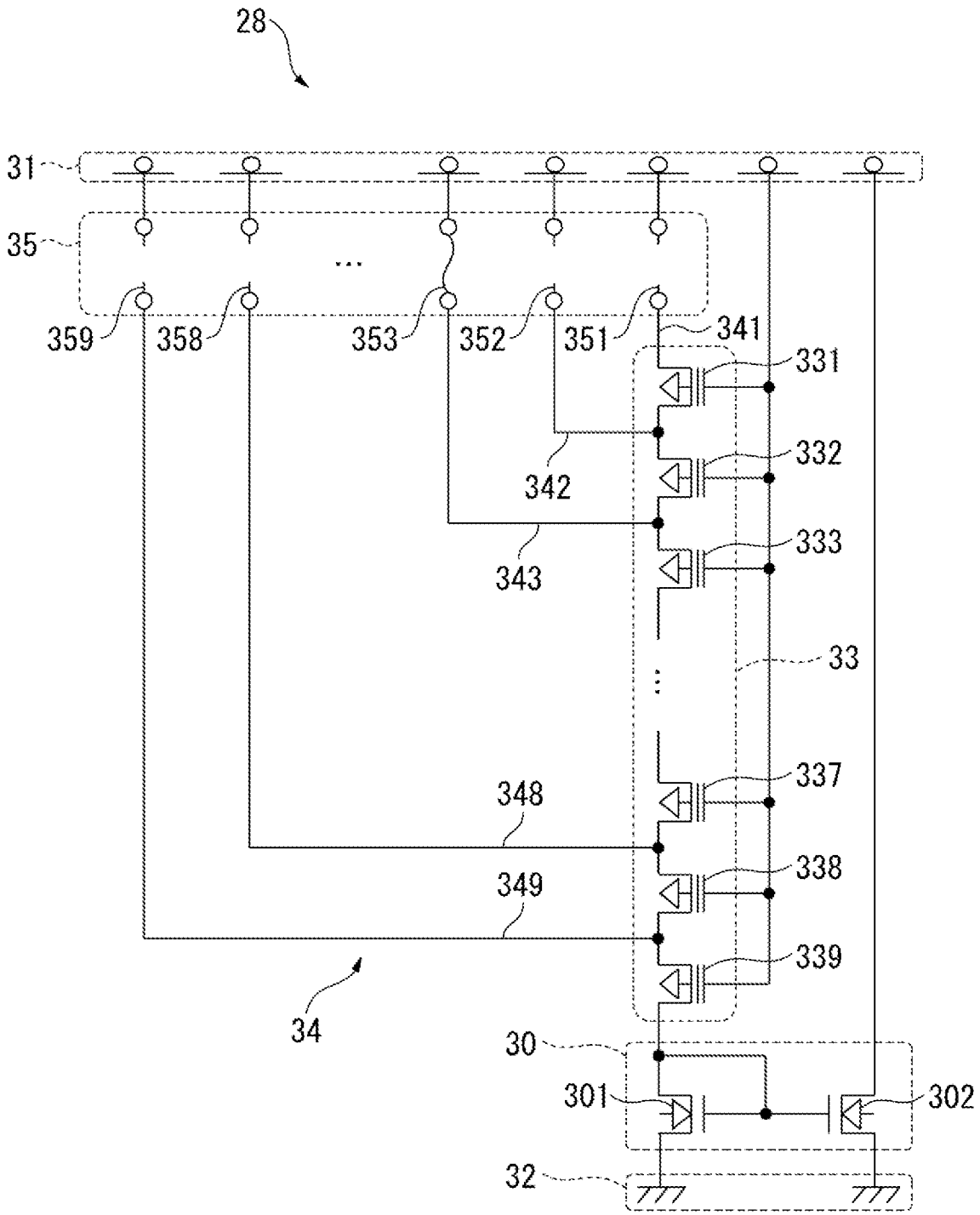
FIG. 5 is a circuit diagram illustrating a constant current circuit of a third embodiment.

FIG. 5 illustrates a third embodiment of the present disclosure.

In the present embodiment, the configurations of the watch 1 and the IC 20 are the same as those of the first embodiment, and therefore overlapping descriptions thereof will be omitted. The present embodiment differs from the first embodiment in that a constant current circuit 28 is provided in the present embodiment in place of the constant current circuit 26 in the IC 20 of the first embodiment.

As with the constant current circuit 26 of the first embodiment, the constant current circuit 28 includes the current mirror circuit 30, the regulating transistor group 33, the connection wiring line group 34, and the selecting fuse group 35. Overlapping descriptions of the same configurations are omitted.

The simulation disconnecting transistor group 36, the disconnection determination wiring line group 39, and the disconnection determining transistor group 37 are not provided in the constant current circuit 28.

In the present embodiment having such a configuration, the constant current can be regulated by selecting the regulating transistors 331 to 339 and the selecting fuses 351 to 359 are used to select the regulating transistors 331 to 339. Thus, the off-leakage current of a known selective transistor does not occur, and therefore it is suitable for the constant current circuit 28 for a watch that supplies a weak constant current.

In the present embodiment, however, the disconnection determination using the disconnection determining transistor group 37 and the simulation disconnection using the simulation disconnecting transistor group 36 as in the first embodiment cannot be performed. However, such functions are functions used for setting the selecting fuse group 35, and do not affect the performance as the constant current circuit 28. The simulation disconnection function and the disconnection determination function can be achieved by selecting the connection wiring lines 341 to 349 that supply the power supply by using a test circuit that supplies the first power supply 31 and the second power supply 32 in a test.

Thus, according to the present embodiment, the same effects as those of the above-described first embodiment can be achieved except for the effects of the simulation disconnection and the disconnection determination.

Fourth Embodiment

Figure 6:
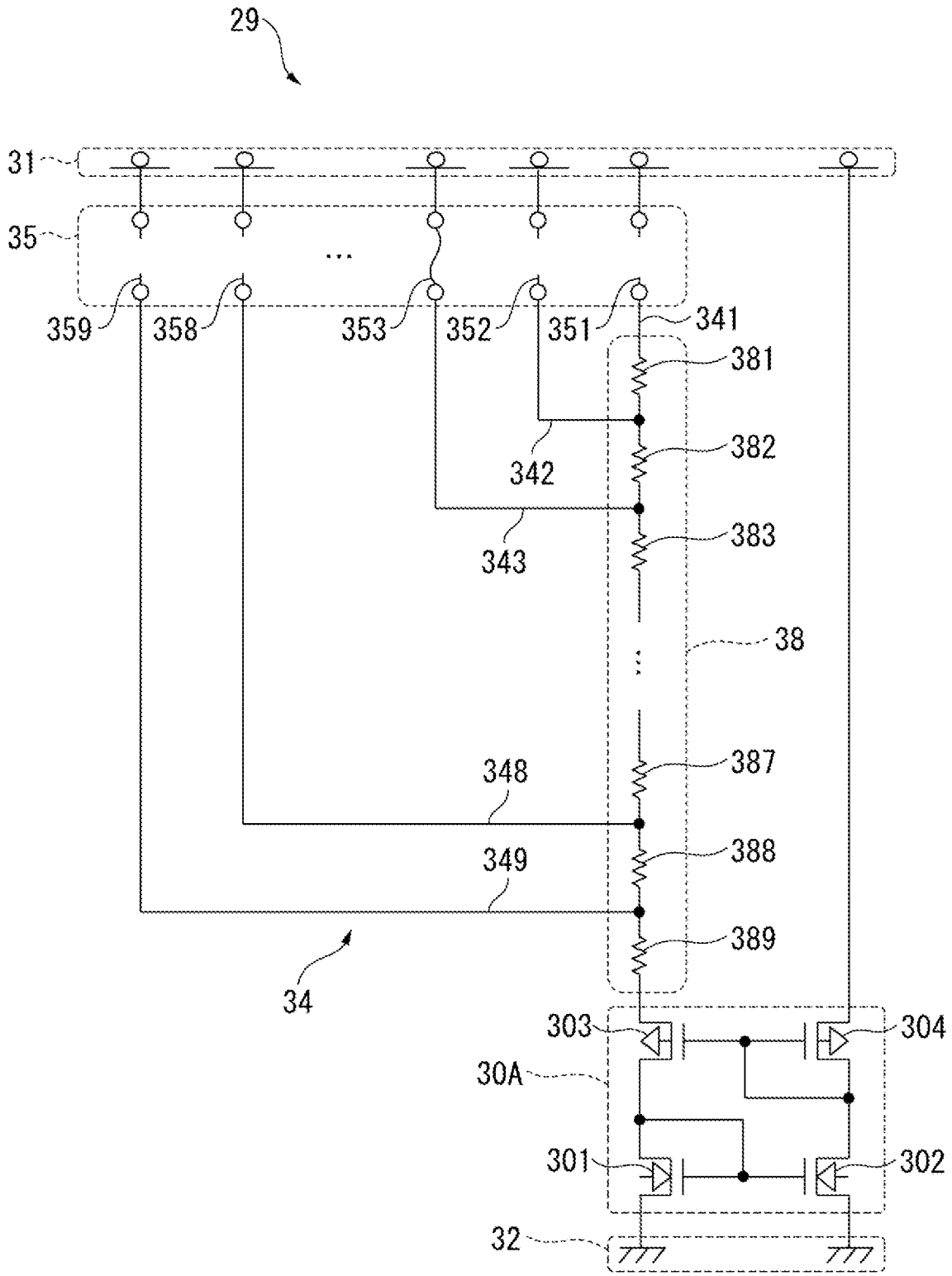
FIG. 6 is a circuit diagram illustrating a constant current circuit of a fourth embodiment.

A fourth embodiment of the present disclosure is illustrated in FIG. 6.

In the present embodiment, the configurations of the watch 1 and the IC 20 are the same as those of the first embodiment, and therefore overlapping descriptions thereof will be omitted. The present embodiment differs from the first embodiment in that a constant current circuit 29 is provided in the present embodiment in place of the constant current circuit 26 in the IC 20 of the first embodiment.

As with the constant current circuit 27 of the second embodiment, the constant current circuit 29 includes the current mirror circuit 30A, the connection wiring line group 34, the selecting fuse group 35, and the regulating resistor group 38. Overlapping descriptions of the same configurations are omitted.

The simulation disconnecting transistor group 36, the disconnection determination wiring line group 39, and the disconnection determining transistor group 37 are not provided in the constant current circuit 29.

In the present embodiment having such a configuration, a constant current can be regulated by selecting the regulating resistance elements 381 to 389 and the selecting fuses 351 to 359 are used for selection of the regulating resistance elements 381 to 389. Thus, the off-leakage current of a known selective transistor does not occur, and therefore it is suitable for the constant current circuit 29 for a watch that supplies a weak constant current.

In the present embodiment, however, the disconnection determination using the disconnection determining transistor group 37 and the simulation disconnection using the simulation disconnecting transistor group 36 as in the second embodiment cannot be performed. However, such functions are functions for setting the selecting fuse group 35, and do not affect the performance as the constant current circuit 29. The simulation disconnection function and the disconnection determination function can be achieved with a test circuit as described in the third embodiment.

Thus, according to the present embodiment, the same effects as those of the above-described second embodiment can be achieved except for the effects of the simulation disconnecting and the disconnection determination.

Fifth Embodiment

Figure 7:
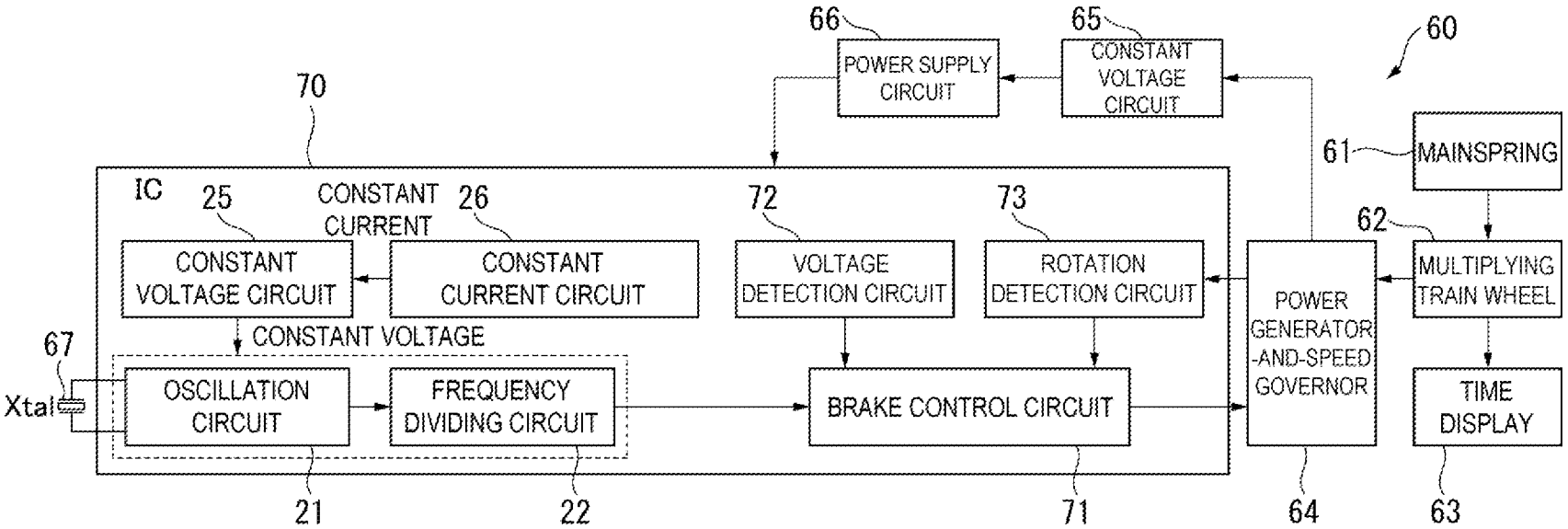
FIG. 7 is a block diagram illustrating a movement of a fifth embodiment.

FIG. 7 illustrates a fifth embodiment of the present disclosure.

In the first embodiment, the constant current circuit 26 is applied to the watch 1, which is an electronic watch.

In contrast, in the present embodiment, the constant current circuit 26 is applied to a watch 60, which is an electronic mechanical watch.

In FIG. 7, the watch 60 includes a mainspring 61 serving as a mechanical energy source, a multiplying train wheel 62 serving as an energy transfer device that transmits torque of the mainspring 61, a time display device 63 coupled to the multiplying train wheel 62 and configured to display a time, a power generator-and-speed governor 64 that is driven by a torque transmitted through the multiplying train wheel 62, a rectifier circuit 65, a power supply circuit 66, a crystal oscillator 67, and an IC 70 for rotational control.

The time display device 63 includes the hands of FIG. 1, the second hand 5, the minute hand 6, and the hour hand 7. The power generator-and-speed governor 64 is driven by the mainspring 61, and generates a predetermined DC voltage by the power supply circuit 66 through the rectifier circuit 65.

The IC 70 includes a brake control circuit 71, a voltage detection circuit 72, and a rotation detection circuit 73, and includes the oscillation circuit 21, the frequency dividing circuit 22, the constant voltage circuit 25, and the constant current circuit 26 as in the first embodiment.

Among them, the voltage detection circuit 72 detects the voltage of the power supply circuit 66. The rotation detection circuit 73 detects the rotation of the power generator-and-speed governor 64 and outputs the rotation to the brake control circuit 71.

The brake control circuit 71 refers to the rotation detection signal from the rotation detection circuit 73 and the detected voltage value from the power supply circuit 66, and outputs, to the power generator-and-speed governor 64, a chopping signal for speed regulation.

With the power supply circuit 66 as the first power supply 31 and the second power supply 32 and the configuration described in the first embodiment, the constant current circuit 26 outputs a constant current having stable temperature characteristics. With a stable constant current, a constant voltage having stable temperature characteristics is output from the constant voltage circuit 25. As a result, a reference signal having stable temperature characteristics is output from the oscillation circuit 21 or the frequency dividing circuit 22, and, on the basis of the reference signal, the brake control circuit 71 can accurately perform the speed control of the watch 60.

With the constant current circuit 26, the present embodiment can also achieve the effects described in the first embodiment.

Other Embodiments

Note that the present disclosure is not limited to the above-described embodiments, and includes modifications and the like within the scope in which the object of the present disclosure can be achieved.

While nine elements are disposed in each of the regulating transistor group 33, the connection wiring line group 34, the selecting fuse group 35, the simulation disconnecting transistor group 36, the disconnection determining transistor group 37, and the regulating resistor group 38 in the above-described embodiments, the number of the elements may be eight or less, or ten or more.

While the current mirror circuits 30 and 30A that generate a constant current with an input of a current regulated by the regulating transistor group 33 or the regulating resistor group 38 are used in the above-described embodiments, other configurations may be used as a circuit for generating a constant current as long as regulation can be performed by the regulating transistor group 33 or the regulating resistor group 38.

In the above-described embodiments, both the simulation disconnecting transistor group 36 and the disconnection determining transistor group 37 are disposed in the first embodiment and the second embodiment, and the simulation disconnecting transistor group 36 and the disconnection determining transistor group 37 are omitted in the third embodiment and the fourth embodiment. However, it is also possible to dispose only one of the simulation disconnecting transistor group 36 and the disconnection determining transistor group 37.

While the first power supply 31 is a high potential side power supply and the second power supply 32 is a low potential side power supply in the above-described embodiment, they may be disposed in an opposite manner. In this case, it suffices that each transistor in the regulating transistor group 33, the simulation disconnecting transistor group 36, and the disconnection determining transistor group 37 performs an operation such as an operation of reversing the polarity.

While a battery is used as the power supply 12 that provides the first power supply 31 and the second power supply 32 in the first to fourth embodiments, it is also possible to use a power supply of a combination of a power generation device such as a rotating weight, a power generator and a solar cell, and an accumulator such as a secondary battery and a capacitor.

While the watch 1 is a wristwatch that is worn around the wrist of the user in the embodiment, the watch 1 may be a pocket watch, a stationary clock, or a clock incorporated in equipment.

What is claimed is:

1. A watch comprising a constant current circuit, the constant current circuit including:

a plurality of transistors coupled in series between a first power supply and a second power supply, the first power supply being one of a high potential side power supply and a low potential side power supply, the second power supply being the other of the high potential side power supply and the low potential side power supply;

a plurality of connection wiring lines each provided for each of the plurality of transistors, each of the plurality of connection wiring lines being configured to couple the first power supply and a terminal on the first power supply side of each of the plurality of transistors;

a non-disconnected fuse provided in a non-disconnected state to one connection wiring line of the plurality of connection wiring lines; and a disconnected fuse provided in a disconnected state to each of the rest of the connection wiring lines other than the one connection wiring line of the plurality of connection wiring lines.

2. The watch according to claim 1, wherein the constant current circuit includes a plurality of simulation disconnecting transistors configured to switch each of the plurality of connection wiring lines between a disconnected state and a connected state.

3. The watch according to claim 1, wherein the constant current circuit includes a plurality of disconnection determination wiring lines each configured to couple the second power supply, and the non-disconnected fuse and the disconnected fuse; and a plurality of disconnection determining transistors are coupled to each of the plurality of disconnection determination wiring lines.

4. The watch according to claim 1, comprising:

a constant voltage circuit configured to receive a constant current output from the constant current circuit and output a constant voltage; and an oscillation circuit driven by the constant voltage output from the constant voltage circuit.

5. The watch according to claim 1, wherein the constant current circuit includes a current mirror circuit including a first current stabilizing transistor coupled between the second power supply and the plurality of transistors, and a second current stabilizing transistor coupled between the first power supply and the second power supply.

6. A watch comprising a constant current circuit, the constant current circuit including:

a plurality of resistors coupled in series between a first power supply and a second power supply, the first power supply being one of a high potential side power supply and a low potential side power supply, the second power supply being the other of the high potential side power supply and the low potential side power supply;

a plurality of connection wiring lines each provided for each of the plurality of resistors, each of the plurality of connection wiring lines being configured to couple the first power supply and a terminal on the first power supply side of each of the plurality of resistors;

a non-disconnected fuse provided in a non-disconnected state to one connection wiring line of the plurality of connection wiring lines; and a disconnected fuse provided in a disconnected state to each of the rest of connection wiring lines other than the one connection wiring line of the plurality of connection wiring lines.

7. The watch according to claim 6, wherein the constant current circuit includes a plurality of simulation disconnecting transistors configured to switch each of the plurality of connection wiring lines between a disconnected state and a connected state.

8. The watch according to claim 6, wherein the constant current circuit includes a plurality of disconnection determination wiring lines each configured to couple the second power supply, and the non-disconnected fuse and the disconnected fuse; and a plurality of disconnection determining transistors are coupled to each of the plurality of disconnection determination wiring lines.

9. The watch according to claim 6, comprising:

a constant voltage circuit configured to receive a constant current output from the constant current circuit, and output a constant voltage; and an oscillation circuit driven by the constant voltage output from the constant voltage circuit.

10. The watch according to claim 6, wherein the constant current circuit includes a current mirror circuit including a first current stabilizing transistor coupled between the second power supply and the plurality of resistors, and a second current stabilizing transistor coupled between the first power supply and the second power supply.

11. A manufacturing method of a constant current circuit, the method comprising:

preparing a constant current circuit including a current mirror circuit coupled between a first power supply and a second power supply, and including a first current stabilizing transistor and a second current stabilizing transistor, a plurality of regulating transistors coupled in series between the first power supply and the first current stabilizing transistor, a plurality of connection wiring lines each provided for each of the plurality of regulating transistors, and configured to couple the first power supply and a terminal on a first power supply side of each of the plurality of regulating transistors, a plurality of fuses inserted to the plurality of connection wiring lines respectively, and a plurality of simulation disconnecting transistors configured to switch each of the plurality of connection wiring lines between a disconnected state and a connected state;

determining a connection wiring line to be selected by sequentially performing on the plurality of connection wiring lines a simulation disconnection in which one of the plurality of connection wiring lines is set to a connected state and the other connection wiring lines are set to a disconnected state by using the plurality of simulation disconnecting transistors; and disconnecting a fuse other than a fuse, which corresponds to the connection wiring line to be selected, of the plurality of fuses.

* * * * *